United States Patent [19]

Gordon et al.

[11] 4,013,617

[45] Mar. 22, 1977

[54] PROCESS FOR THE MANUFACTURE OF HYDROPHILIC POLYOLEFIN FIBERS CONTAINING INORGANIC PIGMENT

[75] Inventors: Wolfgang Gordon, Hofheim, Taunus; Hans Joachim Leugering, Frankfurt am Main; Horst Schaefer, Schwalbach, Taunus, all of Germany

[73] Assignee: Hoechst Aktiengesellschaft, Frankfurt am Main, Germany

[22] Filed: May 16, 1975

[21] Appl. No.: 578,157

[30] Foreign Application Priority Data

May 18, 1974 Germany ..... 2424291

[52] U.S. Cl. ..... 260/42.55; 260/42.45

[51] Int. Cl.[2] ..... C08J 3/20

[58] Field of Search ..... 260/42.45, 42.55

[56] References Cited

UNITED STATES PATENTS

| | | | |
|---|---|---|---|
| 3,061,576 | 10/1962 | Roth et al. | 260/42.45 |
| 3,755,244 | 8/1973 | Hart | 260/42.55 |
| 3,865,779 | 2/1975 | Oya et al. | 260/42.44 |

*Primary Examiner*—Donald E. Czaja
*Assistant Examiner*—S. M. Person
*Attorney, Agent, or Firm*—Curtis, Morris & Safford

[57] ABSTRACT

Hydrophilic polyolefin fibers containing inorganic pigments are obtained by means of flash evaporation of a superheated suspension, which is under at least autogenous pressure. The suspension comprises a dispersion of a hydrophobized inorganic pigment in an emulsion prepared from a solution of a polyolefin in an easily boiling solvent and an aqueous solution of a hydrophilizing agent. The suspension is passed through a nozzle into a low pressure zone to form pigmented fibers.

12 Claims, 1 Drawing Figure

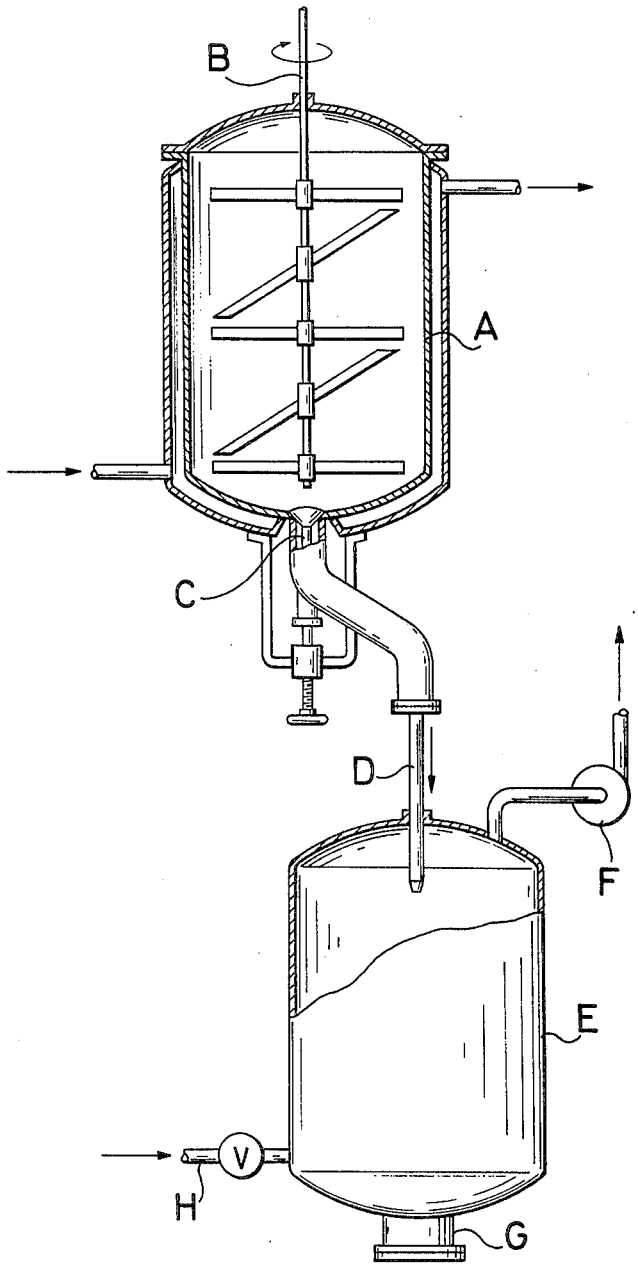
B
A
C
D
F
E
V
H
G

PROCESS FOR THE MANUFACTURE OF HYDROPHILIC POLYOLEFIN FIBERS CONTAINING INORGANIC PIGMENT

Processes for the manufacture of polyolefin fibers containing a pigment have been known for some time. The German Published application Disclosure No. 1,292,301 mentions that pigments and other insoluble compounds may be added "in small amounts" to a superheated polymer solution under pressure prior to the formation of fibers from the polymer solution by flash-evaporation into a low pressure zone. However when this process is employed with polyolefins, the fibers produced are hydropholic and not hydrophilic, with a resulting limitation or their technical employability. Additionally, said application fails to indicate whether and how it might be possible to add to the fibers more than just "small amounts" of pigment. One must assume that in any case the term "small amounts" should be interpreted as indicating less than 20% by weight in relation to the total weight of the fibers.

Germn Published application No. 2,252,759 describes practically the identical process and indicates that up to 50% by weight (in relation to the total weight of the fibers) of insoluble fillers are added. This process also results in the production of hydropholic fibers. Said Application does not take into consideration the special difficulties which are encountered during the manufacture of hydrophilic polyolefin fibers with a high filler content.

German Published application No. 2,121,512 describes a process for the manufacture of polymer fibers by the flash-evaporation of an emulsion consisting of a polymer solution and an aqueous solution of a cross-linking agent, to which pigments may be added. The particular difficulties encountered during this process are not considered and means for overcoming said difficulties are not mentioned in this Application either. Both of the mentioned Applications fail to describe hydropholic polyethylene fibers which contain more than 20% of pigment and neither of the mentioned Applications described any fibers which contain more than 50% of pigment.

A process has now been found for the manufacture of hydrophile polyolefin fibers which contain inorganic pigment, by flash evaporating a superheated suspension which is at least under autogenous pressure, and which consists of an inorganic pigment and an emulsion of a polyolefin solution in an easily boiling solvent for said polymer and an aqueous solution of a hydrophilization agent which are ejected through a nozzle into a low pressure zone. In accordance with the process the pigment employed is an inorganic pigment which has been made hydropholic Suitable polyolefins are high- and low-molecular polyethylene with a reduced specific viscosity between 0.3 and 20 dl/g and preferably between 0.7 and 10 dl/g (determined according to H. Wesslau, Kunststoffe 49 (1959) 230). This polyethylene may contain small amounts of comonomers having 3 to 6 C atoms to the extent that the resulting density is between 0.93 and 0.97 g/cm$^3$, preferably between 0.94 and 0.965. Also appropriate as polyolefins are homo- and co-polymers of propylene, preferably with an atactic component between 0 and 25%, with the best properties being achieved when the atactic content is between 0 to 6%. Preferred propylene copolymers are random copolymers with 0.1 to 3 weight percent or ethylene or with 0.1 to 2 weight percent of butylene. However, block copolymer with ethylene as well as random copolymers with a higher comonomer content may be used.

The suitable hydrophilizing agents comprise all known types of emulsifiers, although polymer hydrophilization agents with amine groups, amide groups, carboxyl groups and/or hydroxyl groups are preferred. Very good results are achieved particularly with polyvinyl alcohol having a solution viscosity (4% at 20° C in water) between 4 and 70 cp and a saponification degree of from 80 to 99.5%.

The polyolefin solvent must have a sufficiently low boiling point in order to permit superheating and flash evaporation. Additionally it must have an adequately high critical temperature. This is why hydrocarbons having from 5 to 7 carbon atoms are suited for the process of the invention, with cyclical or acyclical saturated hydrocarbons of from 5 to 6 carbon atoms being preferred. Chlorinated hydrocarbons of one or two carbon atoms are also well suited, particularly methylene chloride.

The temperature of the suspension may vary widely e.g., between 110° and 200° C. However the temperature range between 120° and 160° C is of the greatest technical interest. This places the suspension under the autogenous pressure of the water-solvent mixture which pressure can be increased with an inert gas and/or by means of a pump.

The suspension consisting of the inorganic pigment and the emulsion formed from the solution of a polyolefin in an easily boiling solvent for this polymer and an aqueous solution of a hydrophilization agent, should be as homogeneous ás posssible. This can be achieved both during discontinuous as well as continuous processing, when this suspension is prepared in commercial suspension and emulsion aggregates with good circulation characteristics and high shearing action. The advantages of the process of the invention obtained can be both with water-in-oil emulsions and with oil-in-water emulsions.

During the flash evaporation the suspension traverses a nozzle the shape of which is not relevant with respect to the present process. The purpose of the nozzle is primarily to maintain a different pressure between the suspension and the flashing zone. The pressure in the flash chamber is selected so that over 90% of the polymer solvent evaporates. This also results in the evaporation of part of the water. The pressure in the flash chamber may thus be between 10 and 1500 mm/Hg and preferably between 50 and 800 mm/Hg. The fibers containing the pigment are mostly obtained in a water-wet form and may be shredded and hydrated in conventional commercially available devices.

The term "pigment particles" refers to small particles of which not more than 5% are soluble either in the water, nor in the solvent for the polyolefin at temperatures up to 200° C. The grain size of the pigments is unimportant as far as the present process is concerned, provided that the obstruction of the nozzle by excessively large pigment particles is avoided. Particularly homogeneous fibers are obtained however when 90% of the pigment particles are smaller than 50 microns and, preferably, even smaller than 10 microns.

The term "hydropholic serves to indicate the water-repellent property of substances. Whether or not a pigment as hydropholic can be tested in the following manner: A test tube is half filled with water and a few milligrams of pigment are placed on the surface of the water. In the context of this description the pigment is to be considered as hydropholic if it remains floating on the surface of the water and as hydrophilic if it sinks to the bottom of the test tube. For the process which is the subject of this invention, one may employ pigments which are either originally hydropholic, or pigments which have been made hydropholic in accordance with known processes. Methods for inducing water-repellency in pigments have been known for some time. The process by which the pigments are made hydropholic is immaterial as far as the present process is concerned. Suitable hydropholizing agents for pigments are represented by organic compounds with an alkyl- and/or aryl radical of at least 6 carbon atoms and a functional polar group, for example mono- or multibasic organic acids of from 10 to 50 carbon atoms or organic amines or ammonium salts of from 6 to 20 carbon atoms. However other hydropholizing agents may be employed as well. The amount of the hydropholizing agent may vary within wide limits e.g. between 0.2 and 5% by weight in relation to the weight of the pigment. A hydropholizing agent content of between 0.3 and 3% is however preferred.

The chemical composition of the inorganic pigments is not of primary importance from a technical point of view. The preferred chemical composition is largely dictated by the availability of an adequately fine-particled pigment at a low price. Such pigments are generally derived from sparingly soluble silicates, aluminates, carbonates or oxides, often in hydrated form. It is not necessary that the pigment be chemically homogeneous. Besides white pigments, colored pigments may be employed in the of the invention process, such as for example soot, chromium (III)-oxide and ferrous (III)- oxide.

The amount of hydropholic pigment which can be employed, may vary to an astonishing degree. Fibers with a pigment content may be obtained that contain anywhere from 1 to 95% by weight of pigment, in relation to the total weight of polyolefin and pigment. The advantages of the present process are particularly impressive with a pigment content of more than 30%. Additional processing advantages are achieved when the pigment content of the fibers is more than 50%. It is preferable however that the pigment content amount to not more than 90%, since beyond said percentage the fibers tend to become too short.

Inorganic pigments are ordinarily hydrophilic. Since the manufacture of hydrophilic polyolefin fibers containing pigments requires the uniform incorporation of a hydrophilizing agent via an aqueous phase, the use of hydrophilic pigments results in considerable complications of a technical nature. Our tests have indicated that only a portion of the hydrophilic pigment is incorporated into the fibers, i.e. surrounded by a polyolefin film. Approximately 40 to 60% of the hydrophilic pigment remains in the original powdery form of the pigment and is rinsed off with the water during the partial mechanical dehydration of the fibers. In order to avoid losses of pigment, quite costly separation and recovery devices would be required. Additionally, a part of the hydrophilic pigment adheres only loosely to the fibers. When the fibers are shredded in conventional fiber shredding devices, whatever pigment has adhered to the fibers is removed and is either lost for good or must be recovered to a large extent. Another factor is that the distribution of the hydrophilic pigment in the fibers is rather irregular, so that a relatively large number of short fibers which are particularly rich in pigment are passed through the paper machine sieve during the manufacture of a sheet of paper, thus adding to the water pollution problems during paper manufacute, unless the water is recycled.

It was not possible to predict how hydrophobized pigments would behave in the presence of hydrophilizing agents for the polyolefin fibers, since the hydrophilizing agent was intended for the hydrophilization of only the polyolefin, but not of the pigments. Consequently it is surprising to find that during the carrying out of the process of the invention the previously described problems are practically absent. The hydropholic pigment is evenly and totally incorporated into the polyolefin fiber. This means that losses during the flashing stage, the shredding of the fibers and the manufacture of paper are very small. These advantages increase in direct portion to an increase in the concentration of pigment in the fiber. When the pigment content exceeds 30%, the difference is so dramatic that the use of hydrophilic pigments gets unreasonably costly. Hydrophilic fibers from polyolefins which contain more than 50% by weight of pigment in relation to the total weight of the fibers, can be manufactured practically only in accordance with the process of the invention. Hydrophilic fibers with a pigment content of between 50 and 90% are thuse completely new.

An additional advantage of the process of the invention consists in the fact that with a pigment content of 50% and more (in relation to the total weight of the pigment and the polyolefin) the fibers produced during the flash evaporation are particularly homogeneous and short, so that in most cases a further shredding of the fibers are homogenization of the fiber length is not required. Without pigment, this result cannot be achieved by known means even with very low polymer concentrations.

Hydrophilic polyolefin fibers with a pigment content between 50 and 90% may be employed as fibrous fillers in all fiber fleeces. Compared to non-fibrous pigments they offer the advantage of better retention in these fleeces. Compared to hydrophilic polyolefin fibers without pigment or with a reduced amount of pigment, they offer the advantage of better covering power. For example: calendered paper which contains the fibers of the invention is more opaque than calendered paper which contains the conventional polyolefin fibers. The hydrophilic character of the fibers containing a pigment is required in order to permit the processing of the fibers through an aqueous suspension as is the case during the manufacture of paper.

The advantages of the process of the invention terms of the fiber produced according to the invention will be demonstrated with the aid of the following examples and the drawing.

EXAMPLE 1 with comparative Examples

Referring to the drawing into a pressure vessel A which has a volume of 70 liters and which is equipped with a multi-state, counter-current agitator with 5 flat paddles B, we place 0.4 kg of polyethylene with a density of 0.960 g/cm$^3$ having a reduced specific viscosity of 1.4 dl/g and a molecular weight distribution $M_w/M_n$ of 6, as well as 20 liters of hexane, 15 liters of water, 60 g of polyvinyl alcohol with a solution viscosity of 4 cp (4% in water at 20° C and a saponification degree of 98%), as well as 1.6 kg of hydrated aluminum silicate corresponding to the formula $Al_2O_3 . 2SiO_2 . 2H_2O$ 90% of the particles of which are smaller than 10 microns and with a 1% hydrophobization which had been carried out in accordance with Example 1 of German Patent 847,486; the mixture being emulsified and suspended at 140° C with an agitator speed of 600 rpm. The total pressure in the pressure vessel is adjusted by means of nitrogen to 16 kg/cm². When the valve (C) at the bottom of the pressure vessel is opened, the emulsion flows through the pipe-shaped nozzle (D) which has an inside diameter of 4 mm and a length of 1.20 meters, into vessel (E) in which vacuum pump (F) provides a vacuum of approximately 100 mm/Hg and where the resulting fibers are collected. The hexane residues which have remained in the fibers are removed under vacuum by passing steam over the fibers from the steam supply (H). The fibers containing water are removed from the container (E) through the discharge connection (G) which can be closed.

After partial dehydration by mechanical squeezing to approximately 30% of their volume, the fibers produced contain 76.3% of the hydrophobized aluminum silicate, i.e. the retention during the flash spraying is 95.5%. The produced fibers are hydrophilic and can be dispersed in water without difficulty. When 2 g of these fibers are dispersed in 800 ml of water in a one liter measuring cylinder and the fiber suspension is allowed to settle for exactly two minutes, the fibers sink only slightly, so that after 2 minutes the supernatant water volume which is free of fibers amounts to 40 ml.

When the fibers obtained are classified in a membrane classifier of the Brecht-Holl type for 10 minutes with the sieve at 0.5 atm above atm water pressure and maximum stroke, there remains of a 2 g weighed test sample 10% on a sieve with a 0.40 mm mesh size, and 57% on a sieve with a 0.12 mm mesh size, while 33% of the weighed sample passes through the latter sieve. This indicates that the fibers are so uniform and so short that they may be employed for example for the manufacture of paper without further shredding.

If a sheet of 160 g/m² is manufactured from the fibers obtained in Example 1 on a Rapid-Kothen sheet-forming device, the pigment contained in the sheet amounts to 74.2%, i.e. the pigment retention during the fiber processing stage is 97.3%. On the other hand if one attempts to produce a sheet containing pigment from 75% hydropholic pigment and from 25% of comparable polyethylene fibers which do not contain any pigment, it is found that the pigment retention amounts to only 19%. However, the pigment retention achieved through the fiber formation described in Example 1 is 92.8% up to the fiber processing stage in said Example.

COMPARATIVE EXAMPLE FOR EXAMPLE 1

The same procedure outlined in Example 1 is used, with the pigment consisting of 1.6 kg of hydrated aluminum silicate which has not been made water-repellent, corresponding to the formula $Al_2O_3 . 2SiO_2 . 2H_2O,$ with 90% of the particles being smaller than 10 microns.

Subsequent to partial dehydration by mechanical squeezing to approximately 30%, the produced fibers contain 35.5% pigment, i.e. the pigment retention amounts to only 44.3%.

When these fibers are classified according to Example 2, 84% of the fibers remain on the 0.40 mm mesh sieve, 13% of the fibers remain on the 0.12 mm mesh sieve and 3% of the fibers pass through this latter sieve. Although these fibers are considerably hydrophilic, they are not freely dispersable in a diluted suspension, but continue to cling together.

Only after having been shredded in known manner in a 12-inch disk refiner (manufactured by Messrs. Sprount-Waldron), the fibers are reduced to a length that is comparable to that mentioned in Example 2. Classification indicates 9% retention on the 0.40 mm sieve, 64% retention on the 0.12 mm sieve and 27% pass through the 0.12 mm sieve. Following partial mechanical dehydration as indicated above, the pigment content amounts to only 26%.

When the thus refined fibers are used for forming in a Rapid-Kothen sheet forming device a sheet of 160 g/m², the pigment content in the sheet is only 19%, i.e. the pigment retention between the manufacture of the fibers and the processing of the fibers is only 24%. It appears that there is no possibility of producing by this method hydrophilic fibers containing more than 50% of pigment. The amounts of pigment which have not been retained must be recovered and recycled at considerable cost.

EXAMPLE 2 with comparative Example

In the same manner indicated in Example 1, 0.6 kg of polyethylene with a reduced specific viscosity of 3.4 dl/g and a molecular weight distribution $M_w/M_n$ of 6, the density of which has been established at 0.945 g/cm³ through random copolymerization with butene, and 20 liters of cyclohexane, 10 liters of water, 50 g of polyvinyl alcohol and 0.4 kg of hydrophobized pigment according to Example 1, are emulsified and suspended and fibers are produced by flash spraying. The fibers are then shredded in a disk refiner via 3 refining operations.

In a parallel test, non-hydrophobized pigment according to comparative Example 1 is employed instead of the hydrophobized pigment and the primary fibers obtained are shredded under identical conditions via four refining stages. Table 1 indicates the resulting distribution of the fiber lengths as per Example 2, as well as the pigment contents subsequent to flash spraying, following refining and sheet formation as per Example 3.

TABLE 1

| Pigment | Hydrophile | Hydrophobe |
|---|---|---|
| % pigment used (*) | 40 | 40 |
| % pigment (*) after flash evaporation | 18 | 36 |
| % pigment (*) after shredding | 14 | 31 |
| % pigment (*) in the sheet | 11 | 27 |
| % in 0.40 mm mesh sieve | 20 | 21 |
| % on 0.12 mm mesh sieve | 56 | 47 |
| % traversing 0.12 mm mesh sieve | 24 | 32 |

(*) % of pigment in relation to the total weight of pigment and polyethylene.

EXAMPLE 3 with comparative Example

We emulsify and suspend 1.0 kg polypropylene with a reduced specific viscosity of 2.3 dl/g (0.1% in decaline at 140° C) and 3.3% heptane-soluble parts (12 hours Soxhlett), 20 liters of isopentane, 20 liters of water, 60 grams of polyvinyl alcohol with a solution viscosity of 66 cp (4 g/l in water at 20° C) and a saponification degree of 99%, as well as 1.0 kg of hydrophobized pigment as per Example 1 and subsequent flash spraying as per Example 1 for the manufacture of polypropylene fibers, although this time the suspension is under a pressure of 25 kg/cm² and a pressure of 250 mm/Hg pressure in the flashing chamber. The polypropylene fibers thus produced are subsequently shredded in a disk refiner via a sole processing stage. During the comparative test with non-hydrophobized pigment, as per Example 2, the fibers produced via flash spraying are shredded in two refining stages. The pigment contents and the classification analysis is indicated in Table 2.

TABLE 2

| Pigment | Hydrophile | Hydrophobe |
|---|---|---|
| % of pigment used | 50 | 50 |
| % of pigment after flash evaporation | 24 | 47 |
| % of pigment after shredding | 19 | 42 |
| % of pigment after sheet formation | 16 | 39 |
| % on 0.40 mm mesh sieve | 13 | 16 |
| % on 0.12 mm mesh sieve | 64 | 59 |
| % passing through 0.12 mm mesh sieve | 23 | 25 |

(% of pigment in relation to total weight of pigment and polyethylene)

What is claimed is:

1. A process for the manufacture of pigmented hydrophilic polyolefin fibers which comprises heating at at least an autogenous pressure a mixture of a polyolefin, a readily vaporizable solvent for the polyolefin, water, a hydrophilizing agent which is a water-soluble emulsifier and a particulate inorganic hydrophobic pigment to form a superheated dispersion of said pigment in an emulsion comprising a mixture of a solution of said polymer in said solvent and a solution of said hydrophilizing agent in said water, and passing said superheated dispersion through a nozzle into a relatively low pressure zone to flash evaporate solvent and water from said emulsion and form hydrophilic pigmented fibers of said polyolefin polymer.

2. A process according to claim 1 wherein 90% by weight of the pigment particles are smaller than 50 microns.

3. A process according to claim 1 wherein the pigment is rendered hydrophobic by treating it with 0.2 to 5% by weight of a hydrophobizing agent selected from mono-and multi-basic organic acids having from 10 to 50 carbon atoms and organic amines and ammonium salts having from 6 to 20 carbon atoms.

4. A process according to claim 1 wherein the inorganic pigment is selected from sparingly soluble silicates, aluminates, carbonates, oxides and color pigments in hydrated or non-hydrated form, and the pigment is used in an amount of 5% to 95% by weight, based on the total weight of pigmented fibers.

5. Pigmented hydrophilic polyolefin fibers made by the process of claim 1.

6. Process in accordance with claim 1, wherein a polyethylene having a density of from 0.93 to 0.97 g/cm³ is employed.

7. Process according to claim 1, wherein polypropylene containing an atactic portion of from 0 to 25% is employed as polyolefin.

8. Process according to claim 1, wherein polyvinyl alcohol is employed as a hydrophilization agent.

9. Process according to claim 1, wherein a saturated $C_5$ or $C_6$ hydrocarbon is employed as a solvent for the polyolefin.

10. Process according to claim 1, wherein the temperature of the suspension is between 110° C and 200° C prior to the flash evaporation.

11. Process according to claim 1, wherein the pressure in the flashing zone is between 10 and 1500 mm/Hg.

12. Pigmented hydrophilic polyolefin fibers containing from 50% to 95% by weight of particulate inorganic hydrophobic pigment.

* * * * *